US008028555B2

(12) United States Patent
Lurie

(10) Patent No.: US 8,028,555 B2
(45) Date of Patent: Oct. 4, 2011

(54) PREASSEMBLED CAM LOCK ASSEMBLY

(76) Inventor: Alan E. Lurie, Centerport, NY (US)

( * ) Notice: Subject to any disclaimer, the term of this patent is extended or adjusted under 35 U.S.C. 154(b) by 544 days.

(21) Appl. No.: 12/184,658

(22) Filed: Aug. 1, 2008

(65) Prior Publication Data

US 2010/0024494 A1 Feb. 4, 2010

(51) Int. Cl.
*E05B 9/04* (2006.01)
*E05B 17/04* (2006.01)

(52) U.S. Cl. ..... 70/371; 70/372; 70/379 R; 70/DIG. 42; 70/DIG. 62

(58) Field of Classification Search ..... 70/371, 70/381, 461, 462, DIG. 42, DIG. 62, 379 R, 70/379 A, 380, 78, 84–88, 134, 372; 292/DIG. 62
See application file for complete search history.

(56) References Cited

U.S. PATENT DOCUMENTS 1,835,130 A * 12/1931 Wread ..... 70/370
2,991,643 A * 7/1961 Hitt ..... 70/134
3,089,330 A * 5/1963 Kerr ..... 70/140
3,141,319 A * 7/1964 Schlage ..... 70/81
4,633,689 A * 1/1987 Wolniak et al. ..... 70/379 R
4,903,512 A * 2/1990 Leroy et al. ..... 70/379 R
5,737,950 A * 4/1998 Yun-Bin ..... 70/379 R
6,109,080 A * 8/2000 Chen et al. ..... 70/371
6,758,075 B1 * 7/2004 Thwing ..... 70/389
6,883,356 B1 * 4/2005 Wu ..... 70/379 R
RE38,832 E * 10/2005 Thwing ..... 70/389
7,716,958 B2 * 5/2010 Martin ..... 70/78
2007/0227209 A1 * 10/2007 Massard et al. ..... 70/371

* cited by examiner

*Primary Examiner* — Lloyd Gall
(74) *Attorney, Agent, or Firm* — Michael L. Kroll

(57) ABSTRACT

A preassembled cam lock assembly comprising is disclosed which includes a housing defining a throughbore configured to receive an interchangeable lock core. A tail piece is fixedly secured on a rear face of the housing. The tail piece defines a stepped bore including an arc-shaped cutout. Each end of the arc-shaped cutout defines a stop surface. A cam driver is configured to be rotatably retained in the stepped bore of the tail piece. The cam driver includes a first end defining an arc shaped lost motion slot and a second end adapted to engage a cam. The cam driver has a plurality of spaced bores which are dimensioned to receive a driver pin which is movably positioned within the cutout of the tail piece between the stop surfaces. A cam is secured to the second end of the cam driver adjacent the tail piece. A drive member is positioned within the throughbore of the housing and is adapted to engage an interchangeable lock core such that actuation of the interchangeable lock core effects rotation of the cam driver. The drive member includes a drive pin which is slidably positioned within the lost motion slot of the cam driver such that rotation of the drive member moves the drive pin through the lost motion slot such that the driver pin engages an end of the lost motion slot to effect rotation of the cam driver.

11 Claims, 5 Drawing Sheets

PREASSEMBLED CAM LOCK ASSEMBLY

BACKGROUND

1. Technical Field

The present disclosure relates generally to cam lock assemblies and, more particularly, to cam lock assemblies which are preassembled for a specific use.

2. Background of Related Art

Cam lock assemblies for doors and drawers are well known in the art. Typically, cam lock assemblies include a lock housing, an interchangeable core, a stop washer, and a cam or bolt. Cam lock assemblies can be used for a variety of different purposes in a variety of different orientations. When the lock assembly is assembled and secured to a door or drawer, the installer must properly orient the stop washer on the lock assembly and properly install set screws to achieve a desired result. The proper orientation of the stop washer and set screws on the lock assembly is different for different uses of the lock assembly. For example, the proper orientation of the stop washer and set screw on a lock assembly is different for a right-hand door or drawer lock than the orientation for a left hand door or drawer lock. Thus, if the person installing the lock assembly on a door or drawer positions the stop washer or set screw in the wrong orientation for a desired use, e.g., right hand door lock, the lock assembly will not function in its intended manner.

Accordingly, a need exists in the art for a cam lock assembly which is preassembled for a particular use, e.g., right hand door lock, left hand door lock, etc.

SUMMARY

A preassembled cam lock assembly is disclosed which includes a housing defining a throughbore configured to receive an interchangeable lock core. A tail piece is fixedly secured on a rear face of the housing. The tail piece defines a stepped bore including an arc-shaped cutout. Each end of the arc-shaped cutout defines a stop surface. A cam driver is configured to be rotatably retained in the stepped bore of the tail piece. The cam driver includes a first end defining an arc shaped lost motion slot and a second end adapted to engage a cam. The cam driver has a plurality of spaced bores which are dimensioned to receive a driver pin which is movably positioned within the cutout of the tail piece between the stop surfaces. A cam is secured to the second end of the cam driver adjacent the tail piece. A drive member is positioned within the throughbore of the housing and is adapted to engage an interchangeable lock core such that actuation of the interchangeable lock core effects rotation of the cam driver. The drive member includes a drive pin which is slidably positioned within the lost motion slot of the cam driver such that rotation of the drive member moves the drive pin through the lost motion slot such that the driver pin engages an end of the lost motion slot to effect rotation of the cam driver.

In one embodiment, the arc-shaped cutout of the tail piece extends over an arc of about one hundred eighty-degrees. In another embodiment, the arc-shaped cutout of the tail piece extends over an arc of about ninety degrees.

The arc shaped lost motion slot of the cam driver can extend over an arc of about one-hundred eighty degrees. Alternatively, the arc shaped lost motion slot of the cam driver can extend over an arc of about two hundred seventy degrees.

In one embodiment, the drive member includes first and second pins which are adapted to engage an interchangeable lock core. The drive member can include a disc attached to one end of the first and second pins. The drive pin can extend from a side of the disc opposite the first and second pins. The drive member is configured such that when the first and second pins are positioned at three and nine o'clock, respectively, on the disc, the drive pin is positioned at twelve o'clock.

Alternatively, the drive member can be configured such that when the first and second pins are positioned at three and nine o'clock, respectively, on the disc, the drive pin is positioned between one and two o'clock.

In one embodiment, the housing includes a threaded outer surface and at least one flat. A retaining nut which is configured to threadably engage the threaded outer surface of the housing can be provided.

BRIEF DESCRIPTION OF THE DRAWINGS

Various embodiments of the presently disclosed preassembled cam lock assembly are described herein with reference to the drawings, wherein.

DETAILED DESCRIPTION OF EMBODIMENTS

Figure 1:
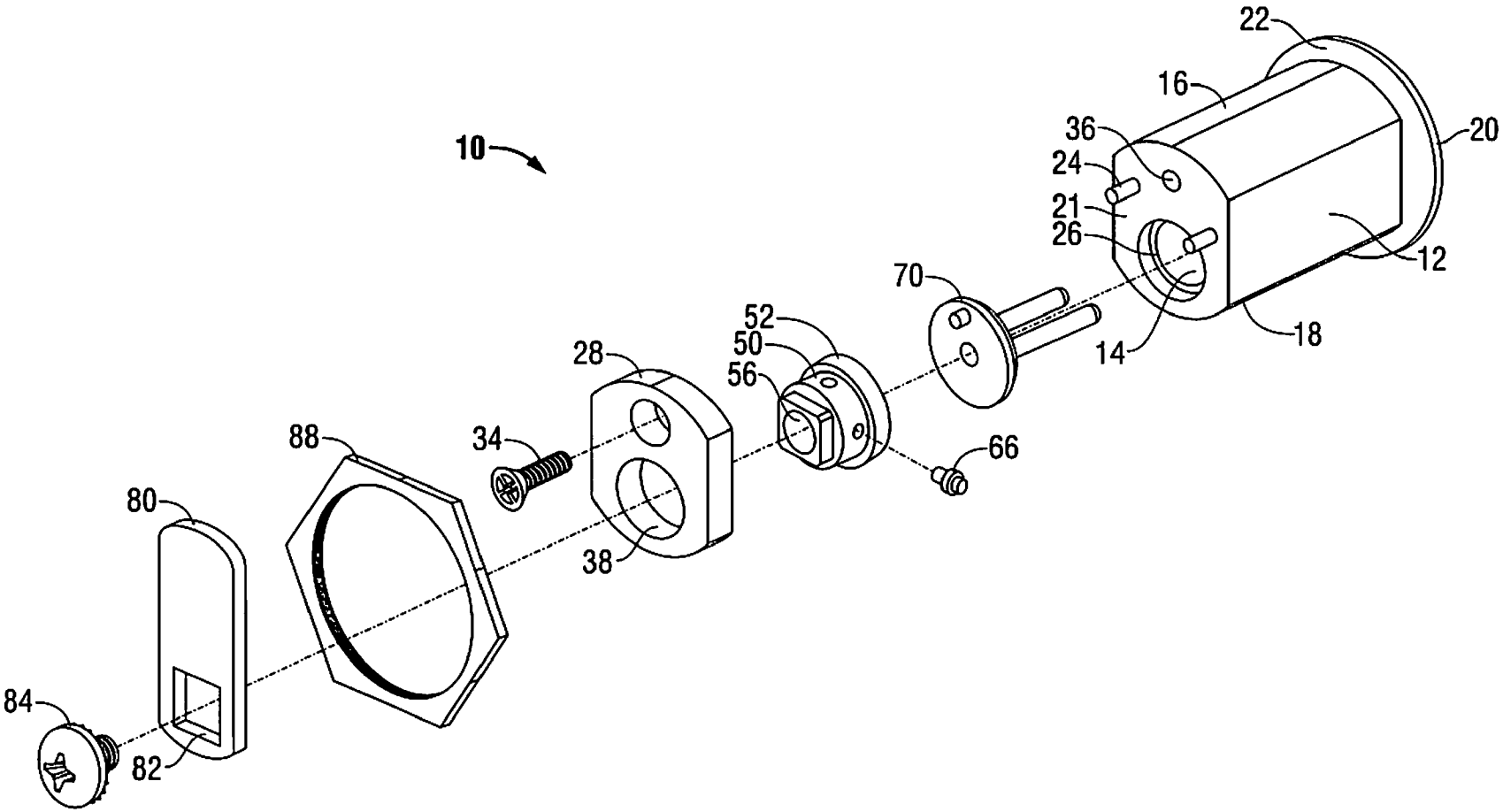
FIG. 1 is a side perspective view from the rear end of one embodiment of the presently disclosed preassembled cam lock assembly.

Embodiments of the presently disclosed preassembled cam lock assembly will now be described with reference to the drawings, in which like reference numerals designate identical or corresponding elements in each of the several views.

Figure 5:
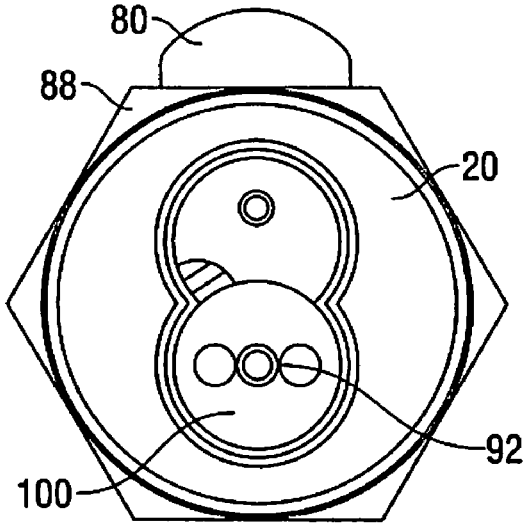
FIG. 5 is a front view of the preassembled cam lock assembly shown in FIG. 1 assembled with an interchangeable lock core positioned within the throughbore of the housing.

Referring to FIG. 1, the presently disclosed preassembled cam lock assembly 10 includes a housing 12 defining a throughbore 14 and including a threaded outer body 16, a pair of flats 18, and a housing front face 20 defining a shoulder 22. A rear face 21 of housing 12 includes a pair of fixed pins 24 and a stepped bore 26 which communicates with throughbore 14. Throughbore 14 is configured to slidably receive an interchangeable core 100 (FIG. 5). A tail piece 28 is configured to be received on rear face 21 of housing 12. Tail piece 28 includes a pair of spaced bores 30 (FIG. 2A) which are dimensioned and positioned to receive fixed pins 24 of housing 12. Pins 24 are received within bores 30 of tail piece 28 to properly position tail piece 28 on housing 12 of lock assembly 10. Tail piece 28 also includes a bore 32 for receiving a screw 34. Screw 34 is threadably received within threaded bore 36 of housing 12 to secure tail piece to housing 12.

Figure 2A:
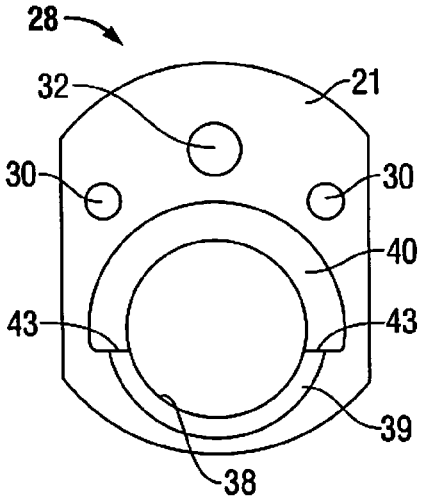
FIG. 2A is a front view of one embodiment of the tail piece of the preassembled cam lock assembly shown in FIG. 1.
Figure 2B:
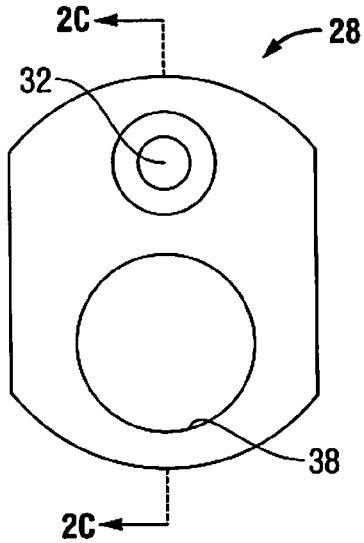
FIG. 2B is a rear view of the tail piece shown in FIG. 2A.
Figure 2C:
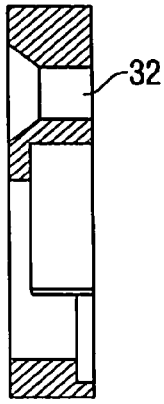
FIG. 2C is a cross-sectional view of the tail piece taken along section lines 2C-2C of FIG. 2B.
Figure 2D:
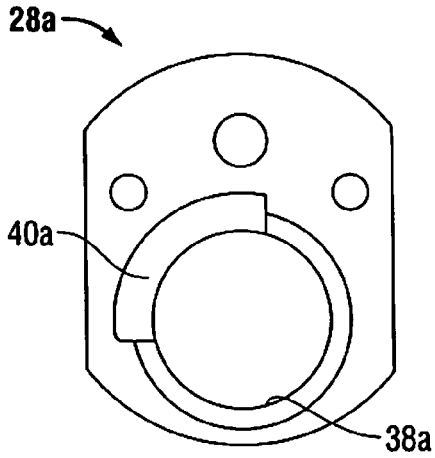
FIG. 2D is a front view of another embodiment of the tail piece of the presently disclosed preassembled cam lock assembly.
Figure 3A:
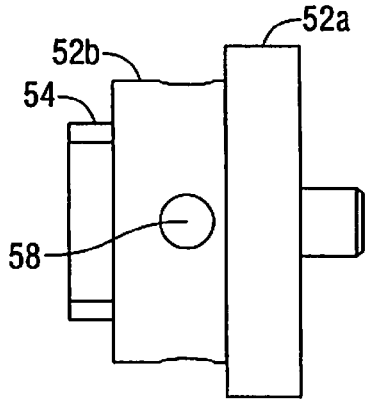
FIG. 3A is a side view of one embodiment of a cam driver of the presently disclosed preassembled cam lock assembly.
Figure 3B:
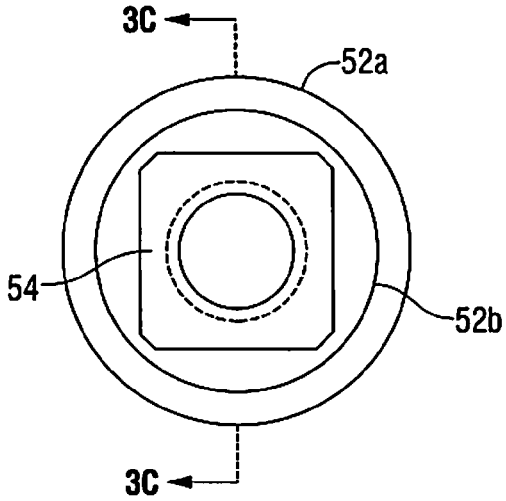
FIG. 3B is a rear view of the cam driver shown in FIG. 3A.
Figure 3C:
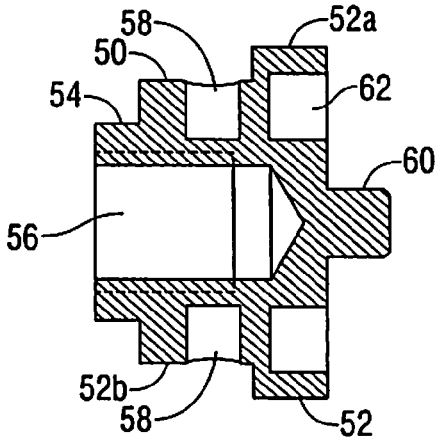
FIG. 3C is a side cross-sectional view of the cam driver taken along section lines 3C-3C of FIG. 3B.
Figure 3D:
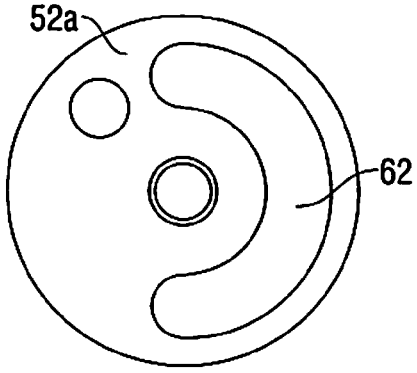
FIG. 3D is a front view of the cam driver shown in FIG. 3A.
Figure 3E:
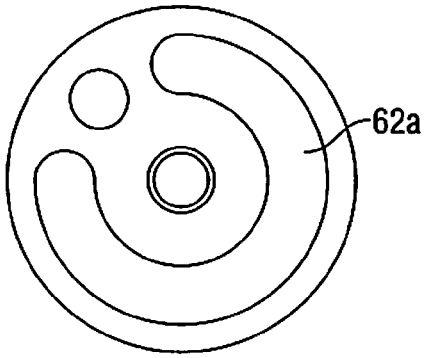
FIG. 3E is a front view of an alternative embodiment of the cam driver shown in FIG. 3D.

Referring also to FIGS. 2A-2C, tail piece 28 defines a stepped bore 38 which includes a circular ledge 39 and an arc-shaped cutout 40. Each end of cutout 40 defines a stop surface 43 which will be discussed in further detail below. Tail piece 28 has two configurations. In one configuration, tail piece 28 is suitable for use with a captive (key-retaining) lock assembly and includes a cutout 40 which has about a one hundred eighty degree arc configuration. In a second configuration, tail piece 28*a* (FIG. 2D) is suitable for use with a captive (key retaining) lock assembly and includes a cut-out 40*a* having a ninety degree arc configuration which will also be discussed in further detail below.

Referring also to FIGS. 3A-3E, lock assembly 10 also includes a cam driver 50 which is rotatably supported within stepped bore 38 of tail piece 28 (28*a*). Cam driver 50 includes a stepped cylindrical body 52 which includes a large diameter body portion 52*a*, and a small diameter body portion 52*b*. Small diameter body portion 52*b* also includes four transverse bores 58 equally spaced about its outer periphery. A rectangular or noncircular head 54 is formed on small diameter portion 52*b*. Cam driver 50 also has a threaded axial bore 56 which extends into head 54. A front face of cam driver 50 includes a central pin 60 and a lost motion arc-shaped slot 62. In one configuration, lost motion slot 62 extends over an arc of about one hundred eighty (180) degrees (FIG. 3*a*) and is suitable for use in a non-captive cam lock assembly. In another embodiment, lost motion slot 62*a* (FIG. 3E) extends over an arc of about two hundred seventy (270) degrees (FIG. 3E) and is suitable for use in a captive cam lock assembly.

As discussed above, small diameter body portion 52*b* of cam driver 50 includes four transverse bores 58. Transverse bores 58 are dimensioned to fixedly receive a driver pin 66 (FIG. 1). Driver pin 66 is dimensioned to be received within cutout 40 or 40*a* of tail piece 28 and is movable between stop surfaces 43 in response to actuation of a key operated interchangeable core (not shown). Driver pin 66 is positioned in a selected one of transverse bores 58 to selectively limit rotation of cam driver 50 in relation to tail piece 28 as will be described in further detail below.

Referring again to FIG. 1 and also to FIGS. 4A-4E, lock assembly 10 also includes a driver 70. Driver 70 includes first and second pins 72*a* and 72*b* which operatively engage an interchangeable core 100 (FIG. 5) such that actuation of the interchangeable core using a key in a known manner effects rotation of driver 70. Driver 70 further includes a disc 74 which is fixedly attached to first and second pins 72*a* and 72*b* such that actuation of the interchangeable core effects rotation of disc 74. Disc 74 includes a pin 76 which is dimensioned to be received within lost motion slot 62 of cam driver 50. When pin 76 engages an end of slot 62, further rotation of disc 74 effects rotation of cam driver 50 as will be discussed in further detail below.

Figure 4A:
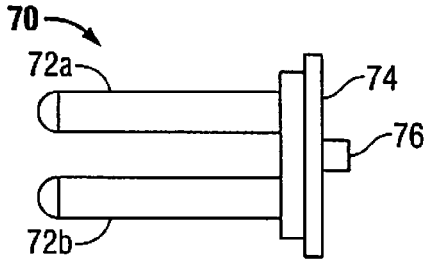
FIG. 4A is a side view of one embodiment of the driver of the presently disclosed preassembled cam lock assembly shown in FIG. 1.
Figure 4B:
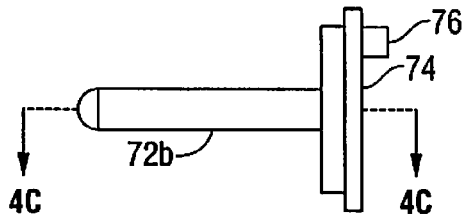
FIG. 4B is a side view of the driver shown in FIG. 4A rotated ninety degrees.
Figure 4C:
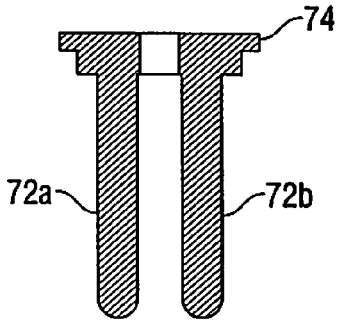
FIG. 4C is a side cross-sectional view of the driver shown in FIG. 4B.
Figure 4D:
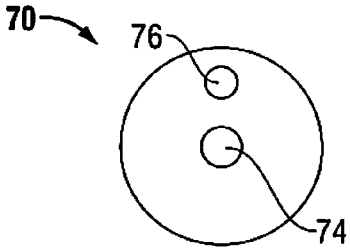
FIG. 4D is a front end view of driver shown in FIG. 4A.
Figure 4E:
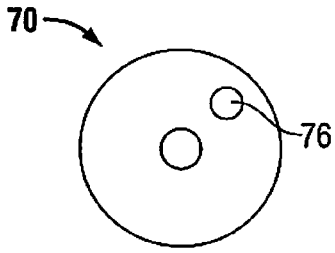
FIG. 4E is a front end view of an alternative embodiment of the driver shown in FIG. 4D.

As illustrated in FIGS. 4A-4D, driver 70 includes a non-captive driver configuration wherein when pins 72*a* and 72*b* are positioned at three o'clock and nine o'clock, pin 76 is positioned at twelve o'clock. FIG. 4E illustrates a captive driver configuration wherein when pins 72*a* and 72*b* are positioned at three o'clock and nine o'clock pin 76 is positioned between one and two o'clock (one-thirty).

Referring again to FIG. 1, lock assembly 10 includes a cam or bolt 80 which is secured to cam driver 50. More specifically, cam 80 includes a rectangular recess 82 which is dimensioned to be non-rotatably received about non-circular head 54 of cam driver 50. A screw 84 is threadably received in threaded axial bore 56 of cam driver 50 to rotatably fix cam 80 to cam driver 50. Lock assembly 10 also includes a retaining bolt 88 which is threadly engaged with housing threads 16 to secure lock assembly 10 to a structure.

Figure 6:
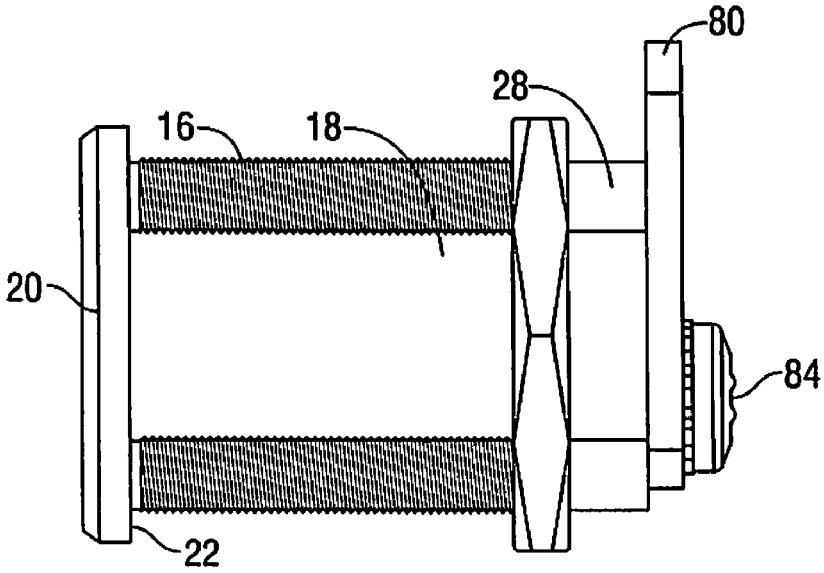
FIG. 6 is a side view of the preassembled cam lock assembly shown in FIG. 5.

Referring to FIGS. 5 and 6, in use, when the components of the lock assembly 10 are assembled, cam driver 50 and 50*a* is rotatably positioned within stepped bore 38 of tail piece 28 with driver pin 66 positioned in a cutout 40 or 40*a*. First and second pins 72*a* and 72*b* are engaged with interchangeable lock core 100 (FIG. 5) and drive pin 76 is positioned within lost motion slot 62 or 62 a of cam driver 50. Cam 80 is secured to cam driver 50 by screw 84. When a key (not shown) is inserted into key slot 92 of interchangeable lock core 100, and rotated, driver 70 is rotated to move drive pin 76 within lost motion slot 62 or 62*a*. When drive pin 76 engages either end wall of slot 62 or 62*a*, further rotation of driver 70 effects rotation of cam driver 50 or 50*a* within stepped bore 38 of tail piece 28. As cam driver 50 or 50*a* is rotated within stepped bore 38 of tail piece 28, driver pin 66 moves within cutout 40 or 40*a* and cam 80 is rotated with cam driver 50 or 50*a*. When driver pin 66 engages stop surface 43 of cutout 40 or 40*a*, it prevents further rotation of cam driver 50.

Cam lock assembly 10 can be preassembled to function as a right hand door or drawer lock, a left hand door or drawer lock, a captive or key retaining lock assembly or a non-captive lock assembly. Thus, during installation of lock assembly 10, the preassembled lock assembly can simply be secured to the door or drawer without the need to properly set stop washers and set screws.

It will be understood that various modifications may be made to the embodiments disclosed herein. Therefore, the above description should not be construed as limiting, but merely as exemplifications of preferred embodiments. Those skilled in the art will envision other modifications within the scope and spirit of the claims appended hereto.

What is claimed is:

1. A preassembled cam lock assembly comprising:

a housing defining a throughbore configured to receive an interchangeable lock core;

a tail piece fixedly secured on a rear face of the housing, the tail piece defining a stepped bore including an arc-shaped cutout, each end of the arc-shaped cutout defining a stop surface;

a cam driver configured to be rotatably retained in the stepped bore of the tail piece, the cam driver including a first end defining an arc shaped lost motion slot and a second end adapted to engage a cam, the cam driver having a plurality of spaced bores which are dimensioned to receive a driver pin, the driver pin being movably positioned within the cutout of the tail piece between the stop surfaces;

a cam secured to the second end of the cam driver adjacent the tail piece; and a drive member positioned within the throughbore of the housing, the drive member being adapted to engage an interchangeable lock core such that actuation of the interchangeable lock core effects rotation of the cam driver, the drive member including a drive pin which is slidably positioned within the lost motion slot of the cam driver such that rotation of the drive member moves the drive pin through the lost motion slot such that the drive pin engages an end of the lost motion slot to effect rotation of the cam driver.

2. The preassembled cam lock assembly, according to claim 1, wherein the arc-shaped cutout of the tail piece extends over an arc of about one hundred eighty degrees.

3. The preassembled cam lock assembly according to claim 1, wherein the arc-shaped cutout of the tail piece extends over an arc of about ninety degrees.

4. The preassembled cam lock assembly according to claim 1, wherein the arc shaped lost motion slot of the cam driver extends over an arc of about one hundred eighty degrees.

5. The preassembled cam lock assembly according to claim 1, wherein the arc shaped lost motion slot of the cam driver extends over an arc of about two hundred seventy degrees.

6. The preassembled cam lock assembly according to claim 1, wherein the drive member includes first and second pins which are adapted to engage an interchangeable lock core.

7. The preassembled cam lock assembly according to claim 6, wherein the drive member includes a disc attached to one end of the first and second pins, the drive pin extending from a side of the disc opposite the first and second pins.

8. The preassembled cam lock assembly according to claim 7, wherein the drive member is configured such that when the first and second pins are positioned at three and nine o'clock respectively, on the disc, the drive pin is positioned at twelve o'clock.

9. The preassembled cam lock assembly according to claim 7, wherein the drive member is configured such that when the first and second pins are positioned at three and nine o'clock, respectively, on the disc, the drive pin is positioned between one and two o'clock.

10. The preassembled cam lock assembly according to claim 1, wherein the housing includes a threaded outer surface and at least one flat.

11. The preassembled cam lock assembly according to claim 10, further including a retaining nut configured to threadably engage the threaded outer surface of the housing.

* * * * *